United States Patent [19]

Crowder

[11] 3,945,147

[45] Mar. 23, 1976

[54] HAND LAUNCH GLIDER

[76] Inventor: Thomas T. Crowder, 2849 E. Great Smoky Ct., Westlake Village, Calif. 91360

[22] Filed: Dec. 18, 1974

[21] Appl. No.: 533,875

[52] U.S. Cl. ..... 46/76 R; 46/78; 46/79

[51] Int. Cl.[2] ..... A63H 27/00

[58] Field of Search ..... 46/75, 76 R, 78, 79, 81

[56] References Cited

UNITED STATES PATENTS

| | | | |
|---|---|---|---|
| 1,693,189 | 11/1928 | Arden | 46/76 R |
| 2,595,074 | 4/1952 | Guillow | 46/79 |
| 3,264,777 | 8/1966 | McCreary | 46/81 |
| 3,388,651 | 6/1968 | Axelrod | 46/76 R |

*Primary Examiner*—Louis G. Mancene
*Assistant Examiner*—Robert F. Cutting
*Attorney, Agent, or Firm*—Jack C. Munro

[57] ABSTRACT

A hand launch glider which includes the use of a fuselage and a wing and an empennage, the fuselage constructed of laminated polystyrene plastic layers bonded on each side of a thin balsa wood core, both the wing and the empennage including connecting means to readily fix the position of each with respect to said fuselage so that the operator will readily know when either the wing or the empennage is misaligned with respect to the fuselage.

10 Claims, 10 Drawing Figures

HAND LAUNCH GLIDER

BACKGROUND OF THE INVENTION

The field of this invention relates to airplanes and particularly to the construction of a hand launch glider.

Hand launch gliders have been made for a substantial number of years and have been used by almost every child and adult. Usually such hand launch gliders are made of balsa wood material which are readily susceptible to damage and as a result normally break only after a few flights. Also, a problem with hand launch gliders of the past has been to accurately position both the wing and the empennage with respect to the fuselage as only a very slight misalignment of either will greatly alter the flight characteristics of the hand launch glider. Even after one has accurately positioned the wing and the empennage, after a single flight the landing will create sufficient jarring movement so as to misalign either or both the wing and the empennage requiring that such be realigned.

Another problem of the past has been that some hand launch gliders included leaded weight in the front of the fuselage and that possibly the hand launch glider, when coming into contact with a window or other breakable material, the weight would cause a breakage of the glass window.

A further problem of the previously employed hand launch gliders is that the gliders are not precisely designed and that generally, their flights are of a short duration. Using the previously constructed hand launch gliders, it has been difficult for one to reach an altitude of over 25 feet, or a flight distance of more than 50 feet.

SUMMARY OF THE INVENTION

One of the objectives of this invention is to design a hand launch glider which is of high strength, lightweight, formed attractive in appearance and resists damage imposed by the impact of hard landings. A further objective is to design a hand launch glider which is capable of reaching altitudes of more than 100 feet and flights up to 100 yards or more in length. A further objective of this invention is to design a hand launch glider which can be constructed to be exact replicas of full scale aircraft. A still further advantage is to include means to insure accurate placement of the wing and the empennage with respect to the fuselage so as to insure true flight by even the unskilled operator. A further advantage of this invention is to employ means for maintaining the correct established position of the empennage and the wing. A further advantage of this invention is to provide for means which facilitates repairing and/or the establishing of any control surfaces. Another advantage of the structure of this invention is to produce rounded, smoothly contoured edges on the fuselage, the wing and/or the empennage.

For a summarial description of the subject matter of this invention, reference is to be had to the Abstract of the Disclosure. For a detailed description of this invention, reference is to be had to the forthcoming detailed description of the invention.

DETAILED DESCRIPTION OF THE SHOWN EMBODIMENTS

Figure 1:
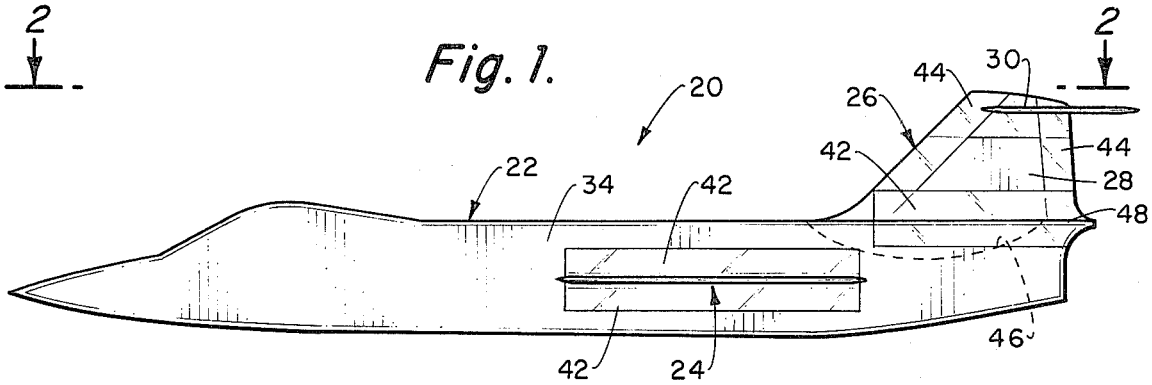
FIG. 1 is a side view of a typical aircraft constructed in accordance with this invention.

Referring particularly to the drawings, there is shown in FIG. 1 a first design of a hand launch glider 20 which is composed of a fuselage 22, a wing 24 and an empennage 26. The empennage 26 consists of a vertical stabilizer 28 and a horizontal stabilizer 30.

The fuselage 22 is constructed of a thin sheet material core 32 of balsa wood, or other similar lightweight material. The grain of the balsa wood is parallel to the length of the fuselage. This positioning of the grain resists crushing due to impact by hard landings. However, the balsa wood itself has a tendency to split along the grain. To avoid this and to make the fuselage construction substantially stronger, on each lateral side thereof is bonded layers 34 and 36 of plastic. The preferable type of plastic is polystyrene. The adhesive can comprise any particular type of adhesive such as a contact cement or glue. It has been generally found that with the thickness of the balsa wood core 32 being about one sixty-fourth of an inch, a satisfactory thickness of the layers 34 and 36 would be five thousandths of an inch. If the core 32 thickness is one quarter of an inch, the satisfactory thickness for the layers 34 and 36 would be approximately twenty thousandths of an inch. However, it is considered to be within the scope of this invention that the thickness of the core 32 and the thickness of the layers 34 and 36 could be varied.

It has been found that upon a hard, crushing impact, that with the plastic layers 34 and 36 bonded to the core 32, that not only is the balsa wood core 32 prevented from splitting (by reason of the layers 34 and 36) but also the polystyrene layers 34 and 36 are prevented from crushing by the fibrous property of the balsa wood. In other words, the combination of the wood core 32 and the plastic layers 34 and 36 combine so that the plastic layers prevents destruction of the core 32 and, in return, the core 32 prevents the crushing of the layers 34 and 36.

Figure 2:
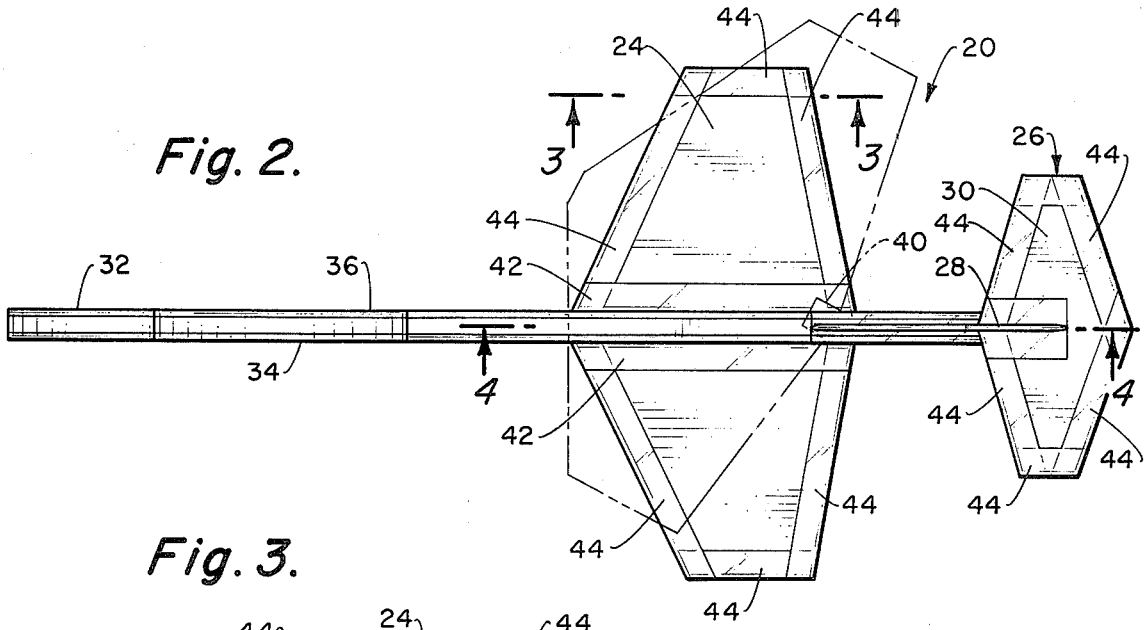
FIG. 2 is a top view of the aircraft taken along line 2—2 of FIG. 1.

Extending transversely through the fuselage 22 is a longitudinal wing slot 38. The wing 24 is constructed from a solid sheet of plastic, such as polystyrene. The wing 24 is shown in FIG. 2 be of a narrow dimension at its outer ends, as opposed to the mid portion of the wing. This particular shape not only is the design for this particular model of airplane, but also facilitates insertion of the wing to be locked in placed with the fuselage 22 which is to be hereinafter described.

Centrally located and formed within the trailing edge (the edge nearest the empennage) of the wing 24 is a notch 40. The longitudinal length of the wing is greater than the length of the slot 38. However, the length of the wing from the inner end of the notch 40 is slightly less than the length of the slot 38. Also, the thickness of the slot 38 is to be equal to the thickness of the wing 24. As the wing 24 is inserted in the slot 38, the wing is tightly gripped by the fuselage 22. The wing must be canted at an angle as shown in the dotted line position in FIG. 2 until the notch 40 begins to extend around the fuselage at the aft end of the slot 38. At that time, the wing 24 is then rotated into position until the fuselage extends into full cooperation within the notch 40. The wing 24 is then to be positioned so that an equal amount of wing area extends on either side of the fuselage 22. The wing 24 is then locked into position due to the cooperation of the notch 40 with the fuselage.

The particular preferred position of the wing 24 (which gives the most desirable flight characteristic) may be fixed in position by the application of adhesive tape 42 at the junction of the fuselage 22 and the wing 24. The tape 42 is to prevent the wing from being jarred from its position during a landing.

Figure 3:
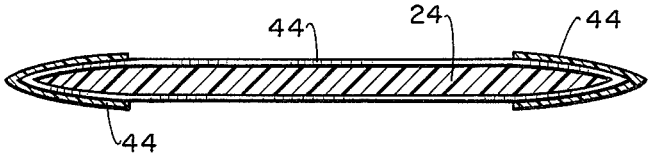
FIG. 3 is a cross-sectional view through the wing of the aircraft taken along line 3—3 of FIG. 2.
Figure 4:
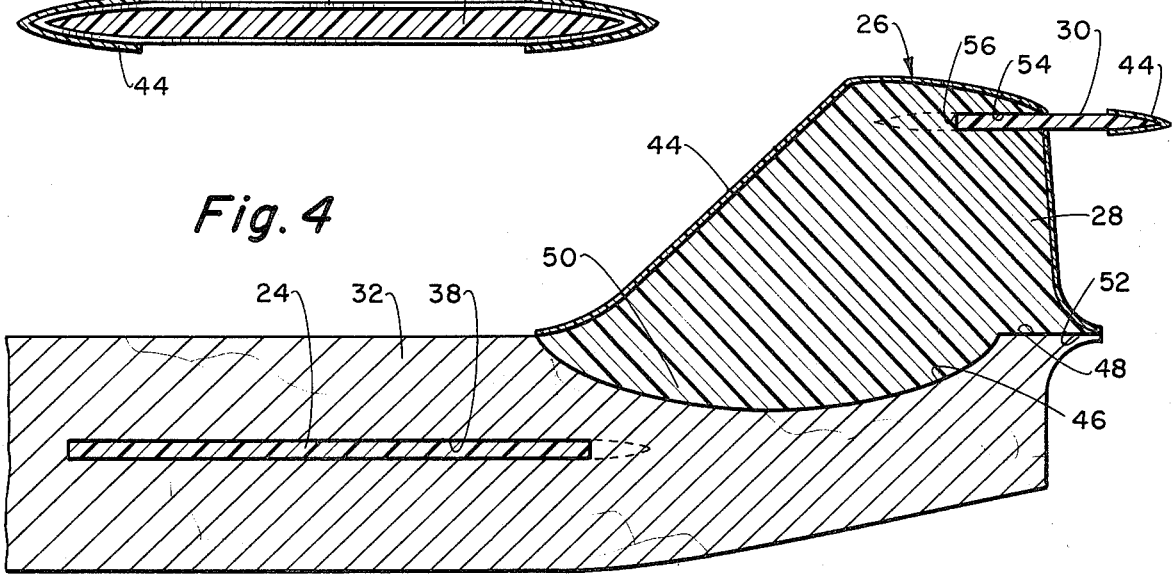
FIG. 4 is a cross-sectional view through the fuselage of the aircraft taken along line 4—4 of FIG. 2.

Also, it is to be noted from the drawings that the leading and trailing edges of the wing surface as well as its outer edges may include strips of adhesive tape 44. The leading and trailing edges of the wing surface 24 may be sharpened such as shown in FIG. 3 of the drawings to facilitate low frictional movement of the wing 24 through the air as the glider is flown. This sharpening of the leading and trailing edges of the wing 24 is accomplished by merely manually squeezing the entire edge area of the wing and this position is maintained due to the tape 44. It is to be noted that one half of the width of the tape is laid on the top edge of the surface and wrapped around the edge with an equal amount of tape laid against the bottom surface of the wing 24.

Formed within the upper edge of the fuselage 22 adjacent the aft end thereof, is a longitudinal arcuate groove 46. The groove 46 is actually formed by removing of a portion of the core 32 leaving the polystyrene plastic in position. In other words, the groove 46 can be defined as being a longitudinal recess having side walls. The location of the groove 46 is slightly spaced from the aft end of the fuselage 22 so as to form a flattened contact area 48. The vertical stabilizer 28 includes an enlarged arcuate protuberance 50 which is to matingly cooperate within the groove 46. The vertical stabilizer 28 also includes a flattened portion 52. This flattened portion 52 can be located either forward or aft of the vertical stabilizer 28. When the vertical stabilizer 28 is in the correct position with the protuberance 50 cooperating within the groove 46, the area 48 is in snug contact with the portion 52 thereby insuring accurate positioning of the vertical stabilizer 28 to achieve maximum flight characteristics. It is also to be noted that the vertical stabilizer 28 may include around its outer edges strips of adhesive tape 44, as was previously described in relation to the wing 24.

Formed adjacent the upper portion of the vertical stabilizer 28 is a first notch 54. A similar length second notch 56 is formed within the horizontal stabilizer 30. The notches 54 and 56 cooperate to securely retain in position the horizontal stabilizer 30 upon the vertical stabilizer 28. The combination of notches 54 and 56 along the groove 46 and area 48 determine the precise position of the horizontal stabilizer 30, in other words, its incidence. Also, it is to be noted that the horizontal stabilizer 30 may include the similar strips 44 of adhesive about its outer edges.

Figure 5:
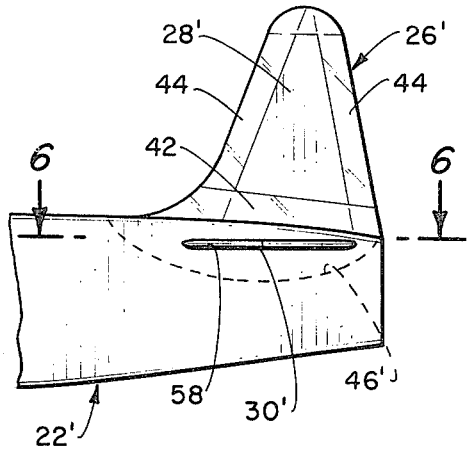
FIG. 5 is a side view of the empennage portion of an aircraft showing a first modified form of connection of the empennage through the fuselage.
Figure 6:
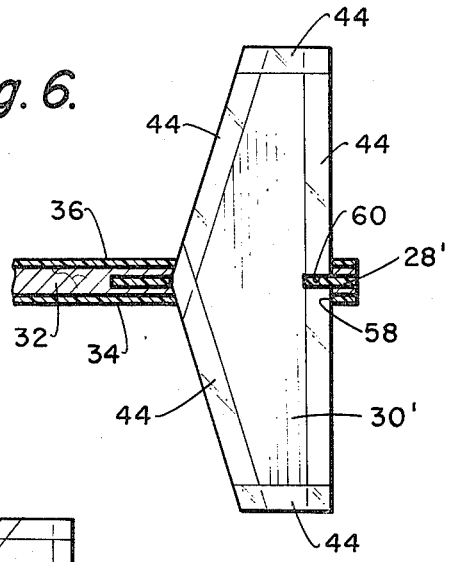
FIG. 6 is a cross-sectional view taken along line 6—6 of FIG. 5.

Referring particularly to FIGS. 5 and 6 of the drawings, a modified form of empennage 26' is shown. Like numerals have been employed to refer to like parts. Instead of the horizontal stabilizer 30' being located at the upper edge of the horizontal stabilizer 28', the horizontal stabilizer 30' extends through a slot 58 formed within the fuselage 22'. Also, a similar length slot is formed within the vertical stabilizer 28' so that when the horizontal stabilizer 30' is placed in position, not only is its position fixed, but also the position of the vertical stabilizer 28'. It is to be noted that the horizontal stabilizer 30' includes a notch 60 to facilitate its locking in position similar to the locked position of the wing 24.

Figure 7:
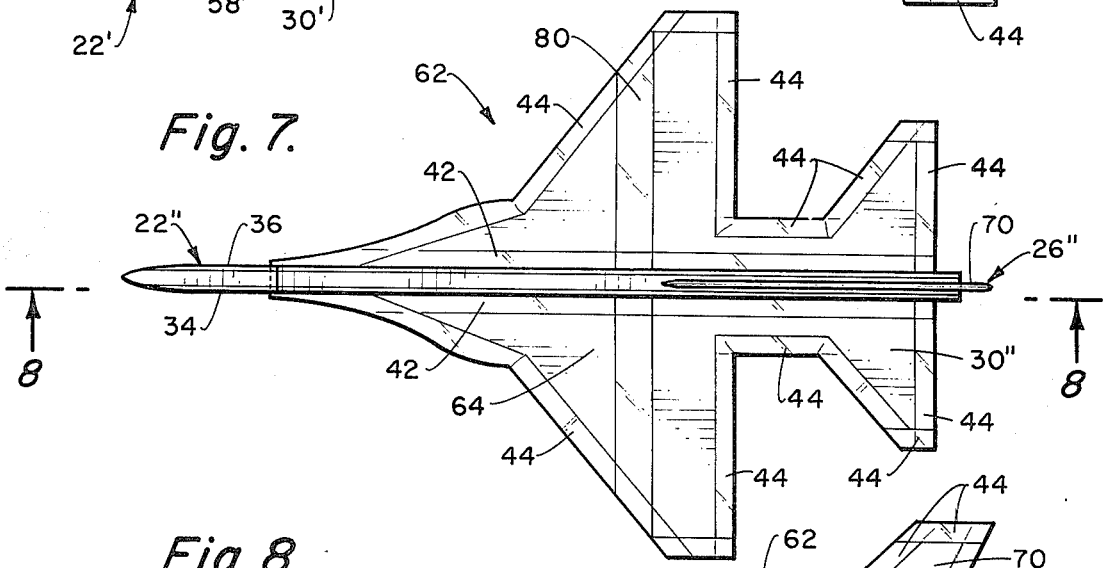
FIG. 7 is a top view of a second aircraft design within which the features of this invention are employed.
Figure 8:
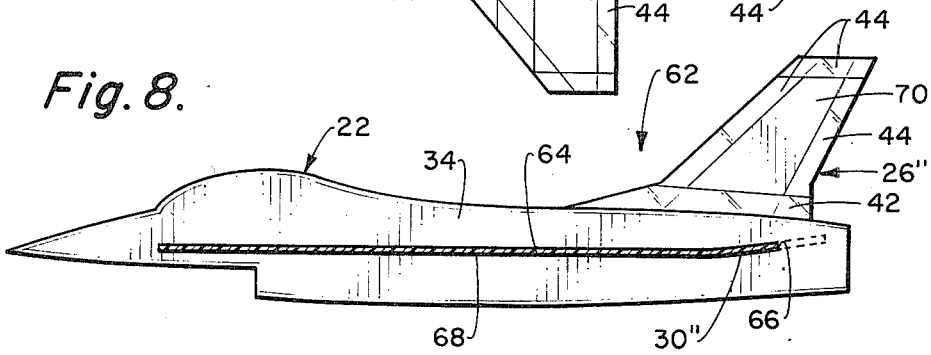
FIG. 8 is a cross-sectional view taken along line 8—8 of FIG. 7.
Figure 9:
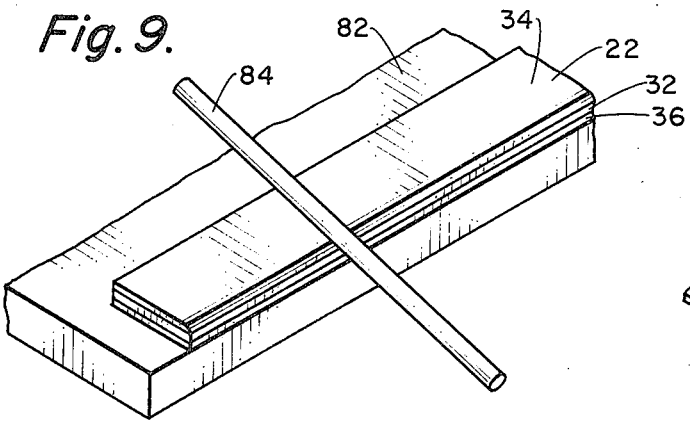
FIG. 9 is a diagrammatic view showing the procedure to form the smoothly contoured edges on the fuselage.

Referring particularly to FIGS. 7 and 8 of the drawings, a modified form 62 of this invention is shown which employs the use of an enlarged wing 64. Actually the wing 64 also has integrally attached thereto the horizontal stabilizer of the empennage. The outer edges of the wing 64 include strips of adhesive tape 44 for reasons as previously explained. The trailing edge of the horizontal stabilizer portion of the wing 64 includes a notch 66 in order to facilitate the locking in place of the wing 64 with respect to the fuselage 22'''. Again, like numerals have been employed to refer to like parts. It is to be noted that the horizontal stabilizer portion 30'' is canted at a small angle with respect to the remaining portion of the of the wing 64. This canting is necessary in order to achieve desirable flight characteristics. This canting is accomplished by the cutting of the slot 68 within the fuselage 22''' at the desired angle. The wing 64 cooperates with the slot 68.

The vertical stabilizer 70 is to include a protuberance similar to protuberance 50 which cooperates with a groove (not shown) within the upper edge of the fuselage 22'''. Also, there is considered to be employed the use of a contact area and a flattened portion similar to area 48 and portion 52.

Figure 10:
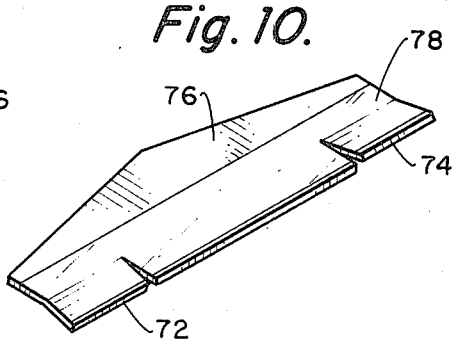
FIG. 10 is an isometric view of a horizontal stabilizer or wing showing how control surfaces can be formed therein.

Referring particularly to FIG. 10 of the drawings, it may be desirable to form certain control surfaces, such as ailerons within either the wing, the horizontal stabilizer or the vertical stabilizer. By way of example, such control surfaces are shown as cut and deformed areas 72 and 74 formed within a horizontal stabilizer 76. By the application of adhesive tape 78 along the control surface hinge line, the position of the control surfaces 72 and 74 can be fixed.

In a similar manner, a control surface can be made such as an airfoil shape by bending the wing to the desired shape and applying adhesive tape thereto. In the reverse, a warp can be eliminated by reversing this procedure.

The use of adhesive tape can also be employed to repair breaks or stiffen portions of the glider, such as the use of the adhesive strip 80 within FIG. 7.

In order to improve the flying characteristics (diminish drag) is normally preferable to round the upper and lower edges of the fuselage. This can be accomplished by placing of the fuselage 22 upon a supportive surface, such as a table 82 and by carefully rounding the edge of the plastic film layers 34 and 36 by rubbing gently therealong with a smooth, round object, such as a dowel 84. This is to be accomplished upon both layers 34 and 36.

What is claimed is:

1. A hand launch glider comprising:

a fuselage having a longitudinal axis parallel to the direction of flight;

a wing connected by first connecting means to said fuselage;

an empennage connected by second connecting means to said fuselage; and said fuselage being constructed of thin, rigid self-supporting layers of plastic and a thin wood panel with the plastic bonded on opposite sides of the thin wood panel, the grain of said thin wood panel running parallel to said longitudinal axis of the fuselage, said plastic layers being substantially identical in thickness.

2. The hand launch glider as defined in claim 1 wherein:

said plastic comprising a thin layer of polystyrene, said wood comprising balsa wood.

3. The hand launch glider as defined in claim 2 wherein:

the thickness of each said plastic layer being at least five thousandths of an inch with the thickness of the balsa wood core being at least one sixty fourth of an inch.

4. The hand launch glider as defined in claim 1 wherein:

said fuselage having an upper edge and a lower edge and a back end and a front end, said fuselage having a longitudinal groove formed within said upper edge adjacent said back end, said empennage including a vertical stabilizer, the bottom edge of said vertical stabilizer to be locatable in a mating relationship within said groove, a portion of said vertical stabilizer to rest against said upper edge to thereby insure accurate placement of said vertical stabilizer upon said fuselage.

5. The hand launch glider as defined in claim 1 wherein:

said fuselage having an upper edge, a lower edge and a fore end and an aft end, the upper edge of said fuselage adjacent said aft end having a groove formed therein, said empennage including a vertical stabilizer, the lower edge of said vertical stabilizer placeable within said groove, said fuselage including a first transverse slot connecting with said groove, said vertical stabilizer including a second transverse slot, with said first and second transverse slots being aligned a horizontal stabilizer portion of said empennage is capable of being inserted through said aligned slots thereby locking the position of said vertical stabilizer with respect to said fuselage.

6. The hand launch glider as defined in claim 1 wherein:

the transverse slot formed through said fuselage, the width of said wing being greater than the length of said transverse slot, the aft end of said wing including a notch at its longitudinal midpoint, the width of said wing from the back end of said notch being no greater than the length of said transverse slot, whereby said wing is to be inserted through said transverse slot and canted in such a manner until a portion of said fuselage cooperates within said notch at which time said wing is to be correctly positioned with respect to said fuselage.

7. The hand launch glider as defined in claim 1 wherein:

said empennage including a vertical stablizer and a horizontal stabilizer, the forward edge of said horizontal stabilizer including a first notch with the trailing edge of said vertical stabilizer including a second notch, said horizontal stabilizer is to be locked in place with respect to said vertical stabilizer by interconnecting said first and second notches.

8. The hand launch glider as defined in claim 1 wherein:

said wing including a forward edge and a trailing edge, strips of adhesive tape to be placed across both said forward edge and said trailing edge so that one half of the width of the tape is laid on the top edge of the wing and wrapped around the edge so that an equal width of tape is placed on the bottom surface of said wing.

9. The hand launch glider as defined in claim 8 wherein:

upon the correct positioning of said wing with respect to said fuselage strips of adhesive tape are applied to both said wing and said fuselage at the interconnection point in order to fixedly position said wing with respect to said fuselage.

10. The hand launch glider as defined in claim 1 wherein:

said fuselage having an upper edge and a bottom edge, depressing each layer of plastic at both said upper edge and said lower edge of said fuselage against said wood core to result in a smoothly contoured said upper edge and said lower edge.

* * * * *